US012637176B2

(12) United States Patent
Nook, III

(10) Patent No.: US 12,637,176 B2
(45) Date of Patent: May 26, 2026

(54) MODULAR CASTING PLATFORM SYSTEM

(71) Applicant: FYSH-USA LLC, Cleveland, OH (US)

(72) Inventor: Joseph H. Nook, III, Cleveland, OH (US)

(73) Assignee: FYSH-USA LLC, Cleveland, OH (US)

( * ) Notice: Subject to any disclaimer, the term of this patent is extended or adjusted under 35 U.S.C. 154(b) by 676 days.

(21) Appl. No.: 17/972,316

(22) Filed: Oct. 24, 2022

(65) Prior Publication Data

US 2023/0129543 A1 Apr. 27, 2023

Related U.S. Application Data

(60) Provisional application No. 63/271,384, filed on Oct. 25, 2021.

(51) Int. Cl.

| | |
|---|---|
| ***B63B 3/48*** | (2006.01) |
| ***B63B 17/04*** | (2006.01) |
| ***B63B 35/14*** | (2006.01) |

(52) U.S. Cl.

CPC ..... *B63B 3/48* (2013.01); *B63B 17/04* (2013.01); *B63B 35/14* (2013.01)

(58) Field of Classification Search

CPC ..... B63B 3/48; B63B 17/04; B63B 35/14

See application file for complete search history.

(56) References Cited

U.S. PATENT DOCUMENTS

| | | | | |
|---|---|---|---|---|
| 3,724,595 A * | 4/1973 | Green | B63B 35/14 | 182/172 |
| 6,244,205 B1 * | 6/2001 | Saccocio | B63B 19/14 | 114/364 |
| 6,988,461 B1 * | 1/2006 | James | B63H 25/02 | 114/364 |
| 8,539,901 B2 * | 9/2013 | Chittum | B63B 17/04 | 114/364 |
| 8,757,459 B2 * | 6/2014 | Crawford | B63B 17/00 | 224/406 |
| 2016/0039499 A1 * | 2/2016 | Cich | B63B 29/10 | 114/352 |

* cited by examiner

*Primary Examiner* — Anthony D Wiest
(74) *Attorney, Agent, or Firm* — BakerHostetler

(57) ABSTRACT

An example of a casting platform system for mounting on a boat deck includes a support frame having a plurality of support legs and a casting platform that is removably attached to the support frame. The casting platform comprises a base plate and a support accessory extending from and supported above the base plate.

18 Claims, 5 Drawing Sheets

MODULAR CASTING PLATFORM SYSTEM

CROSS-REFERENCE TO RELATED APPLICATIONS

The present application claims the benefit of U.S. Provisional Application Ser. No. 63/271,384, filed on Oct. 25, 2021, and entitled MODULAR CASTING PLATFORM SYSTEM, the entire disclosure of which is incorporated herein by reference in its entirety.

TECHNICAL FIELD

This invention relates to fishing boats and equipment for improving the fishing experience for fishermen thereon.

BACKGROUND

Casting from a position that is elevated above the deck of the fishing boat provides improved visibility of nearby fish. An elevated casting platform provides a stable surface from which the fisherman can more easily identify and target fish to catch. The elevated casting platform can include a straight leaning rail for the fisherman to lean against, a wrap-around leaning rail, a cage that provides 360-degree support for the fisherman, or a seat. These sitting or leaning options are typically formed as part of the casting platform and are unable to be removed or altered after installation.

SUMMARY

An example of a casting platform system for mounting on a boat deck includes a support frame having a plurality of support legs and a casting platform that is removably attached to the support frame. The casting platform comprises a base plate and a support accessory extending from and supported above the base plate.

An example of a fishing boat described herein includes a deck, a support frame, and a casting platform. The support frame is supported above the deck by a plurality of support legs and includes a plurality of clamps. The casting platform has a base plate and a support accessory extending upward from the base plate. The base plate is removably attached to the support frame by the plurality of clamps.

An example of a method of using a casting platform system includes the steps of: attaching a first casting platform to a support frame; removing the first casting platform from the support frame; and attaching a second casting platform to the support frame. The support frame has a plurality of support legs, the first casting platform includes a first base plate and a first support accessory extending from the first base plate, and the second casting platform has a second base plate and a second support accessory extending from the second base plate.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which.

DETAILED DESCRIPTION

Figure 1:
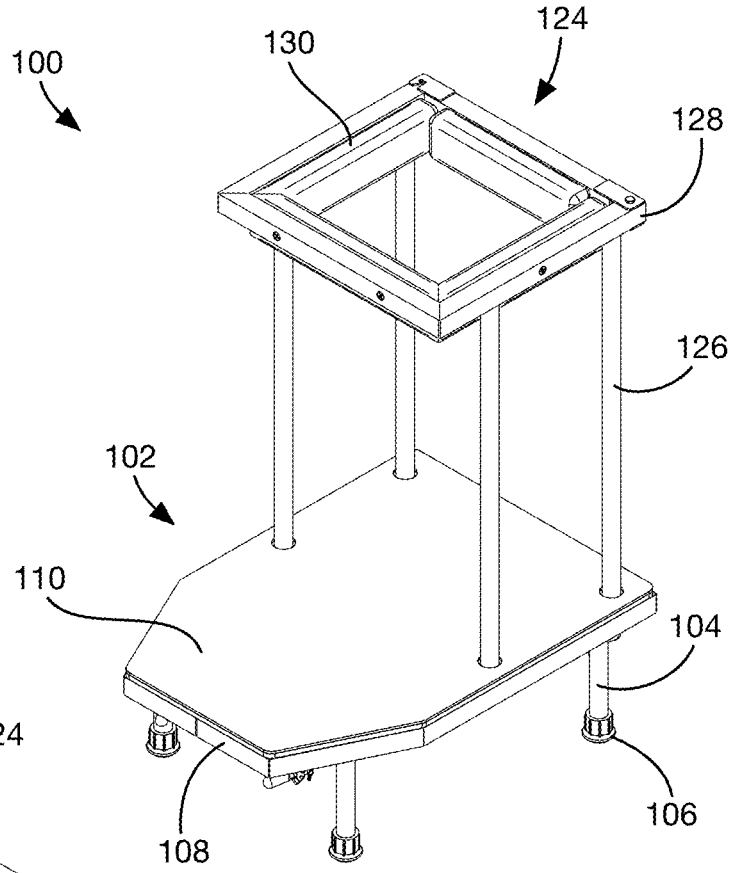
FIG. 1 is a top perspective view of an implementation of a casting platform.
Figure 2:
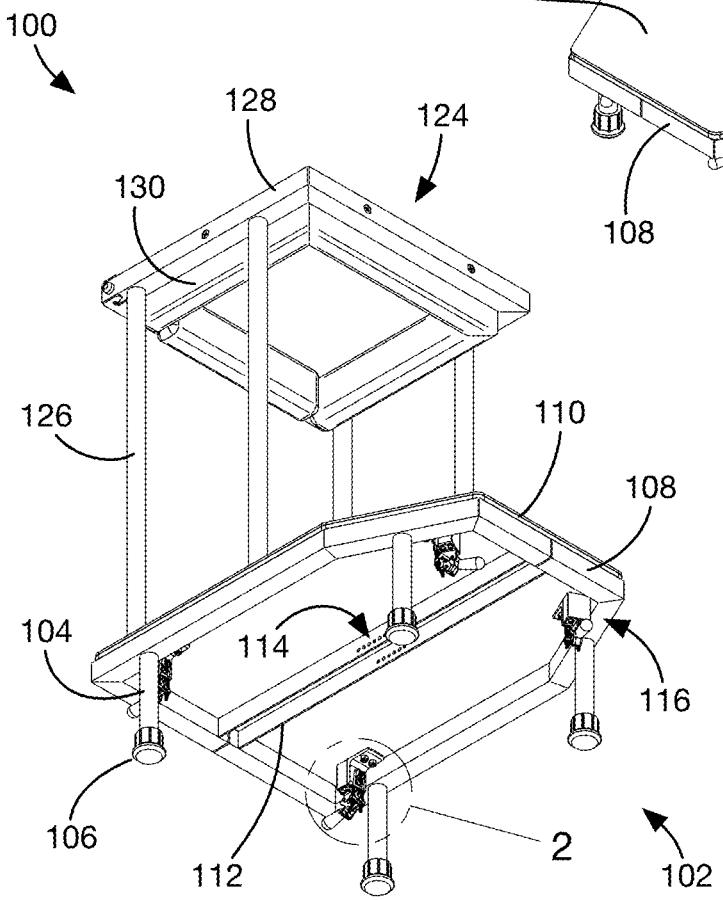
FIG. 2 is a bottom perspective view thereof.
Figure 3:
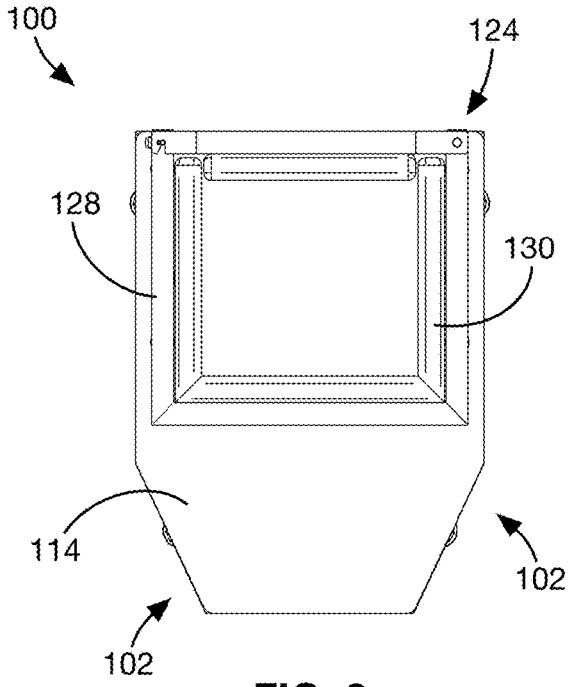
FIG. 3 is a top view thereof.
Figure 4:
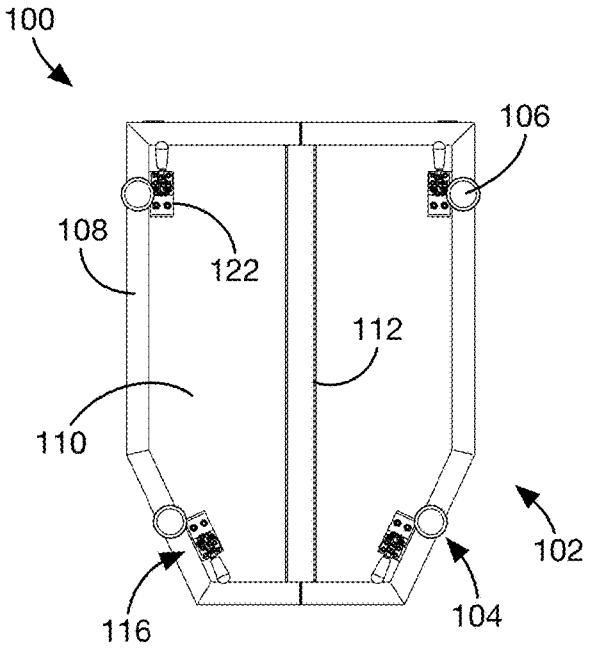
FIG. 4 is a bottom view thereof.
Figure 5:
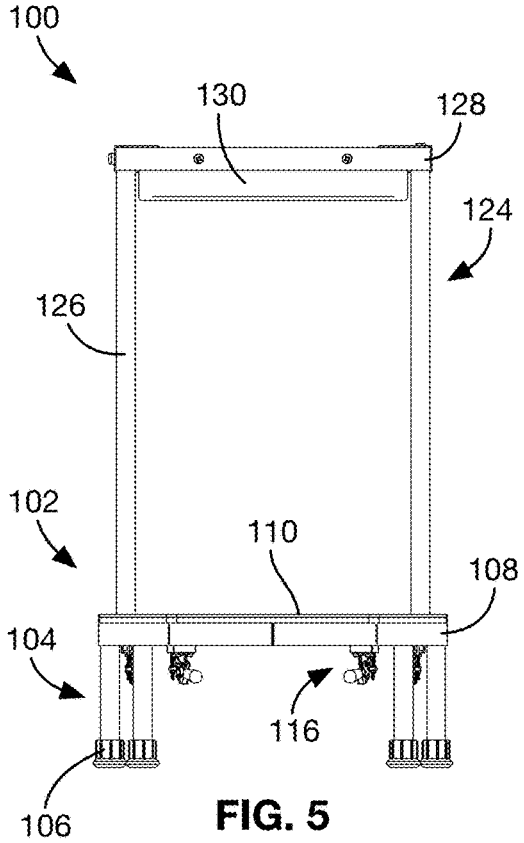
FIG. 5 is a front view thereof.
Figure 6:
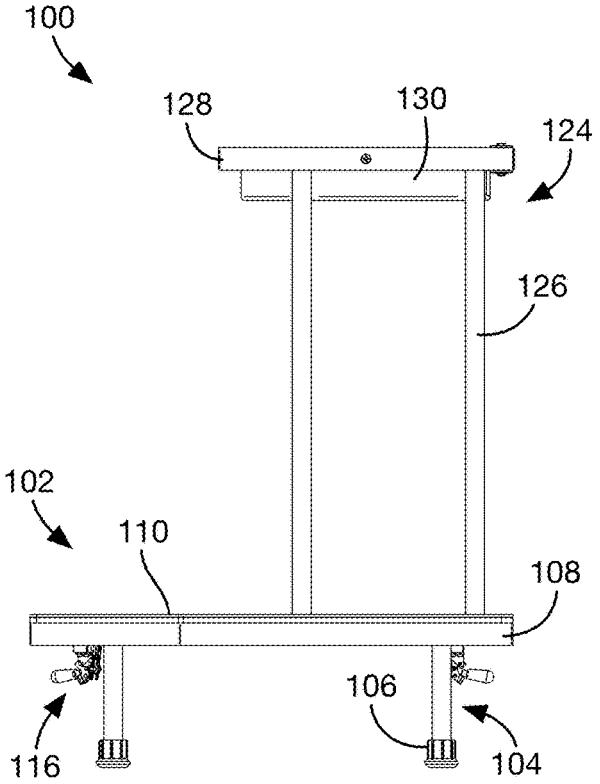
FIG. 6 is a side view thereof.

The following description refers to the accompanying drawings, which illustrate specific embodiments of the present disclosure. Other embodiments having different structures and operation do not depart from the scope of the present disclosure.

It should be noted that various embodiments of casting platform systems are disclosed herein, and any combination of these options can be made unless specifically excluded. In other words, individual components of the disclosed devices and systems can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Referring now to FIGS. 1-10, an exemplary modular casting platform system 100 is shown. The modular casting platform system includes a casting platform 102 that is supported on a boat deck 101 (FIGS. 9-10) by a support frame 108. The support frame 108 is supported by a plurality of support legs or posts 104. The support legs 104 can include optional feet 106 for embodiments of the casting platform 102 that sit on top of the boat deck 101 (as opposed to casting platforms 102 that can be removably fastened to the boat deck with fasteners). The support legs 104 support the support frame 108 at a height above the boat deck 101 that is determined by the length of the support legs 104. The support legs 104 are cut to the desired height of the platform 102 during manufacturing.

Alternatively, the support legs 104 can have an adjustable height via a telescoping mechanism or by being interchangeable with legs or posts having a different height. The illustrated embodiment does not include adjustable members, e.g., the support legs 104, to avoid the noise generated by mechanisms used to connect or join together the moveable members used to adjust, for example, the height of the support legs. Suitable locking mechanisms for enabling the adjustability of the casting platform or support accessory can include, for example, rubberized locking components, such as cams or clamps that facilitate locking the relative positions of the components without parts that could generate noise, such as cotter pins, or the like.

The support legs 104 are attached to the support frame 108 can be arranged around a perimeter of the casting platform 102. The support frame 108 can be formed from any suitable rigid and strong material and supports a base plate 110 of the casting platform 102. For example, the support frame 108 can be formed from welded together segments of metal tubing having a square, rectangular, round, or other suitable cross-sectional profile, the tubing being formed from any suitable metal alloy, such as alloys of aluminum, steel, and the like. An optional center beam 112 can extend between two sides of the support frame 108 to provide additional support, stiffness, and rigidity to the base plate 110 of the casting platform 102. The center beam 112 can optionally include an attachment location 114 including one or more holes or other features for receiving a securing member 134 (FIG. 10) that attaches the center beam 112 of the casting platform 102 to the deck 101 of the boat. The attachment or securing member can take on a wide variety of forms, such as, for example, a turnbuckle, a rod with hooked ends, a tie down strap or line, or the like.

Figure 7:
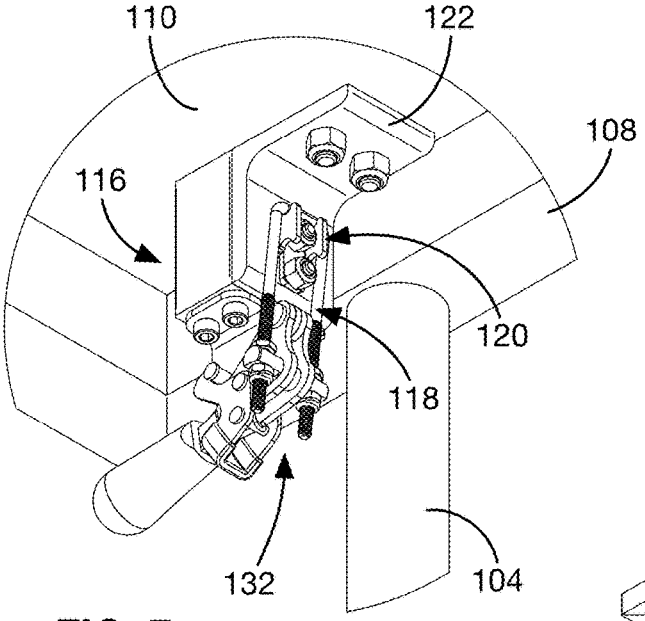
FIG. 7 is an enlarged detail view of area 2 of FIG. 2.
Figure 8:
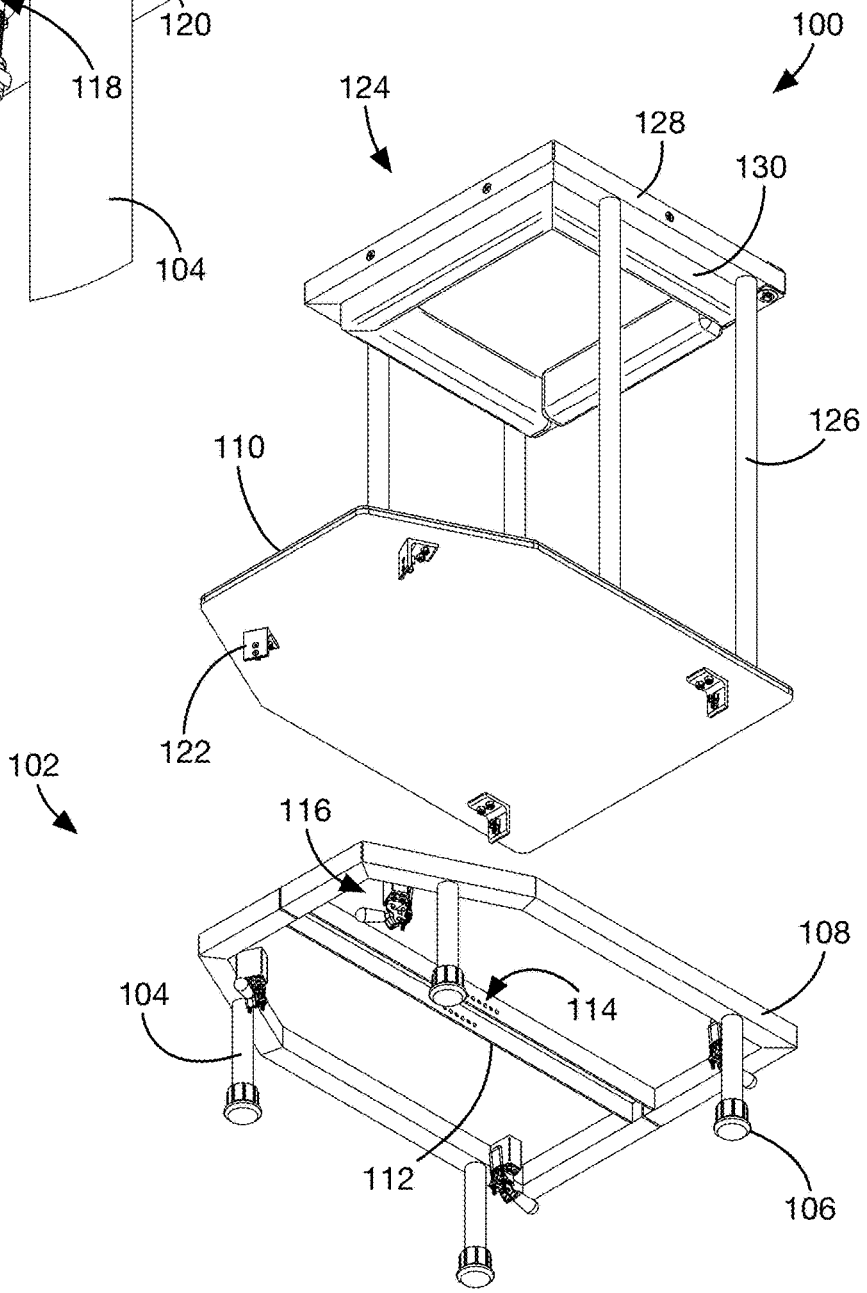
FIG. 8 is a bottom perspective exploded view of the casting platform of FIG. 1.
Figure 9:
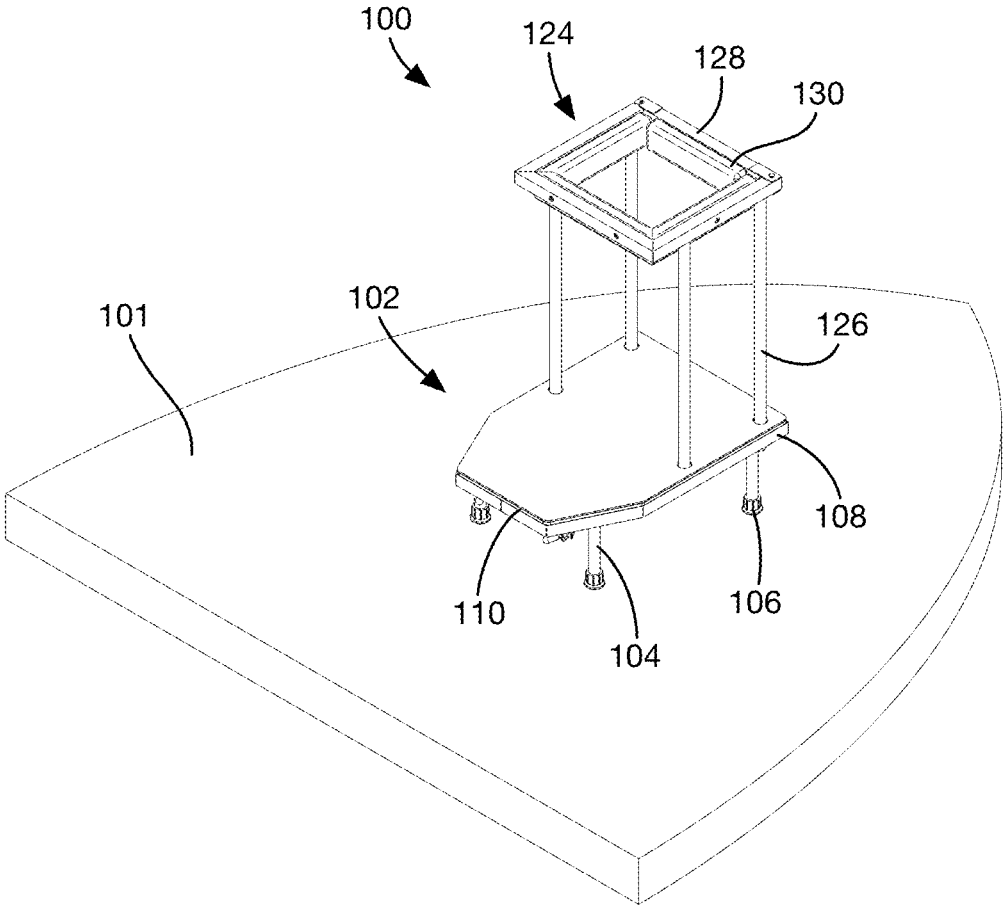
FIG. 9 is a top perspective view of the casting platform of FIGS. 1-8 attached to a boat deck.
Figure 10:
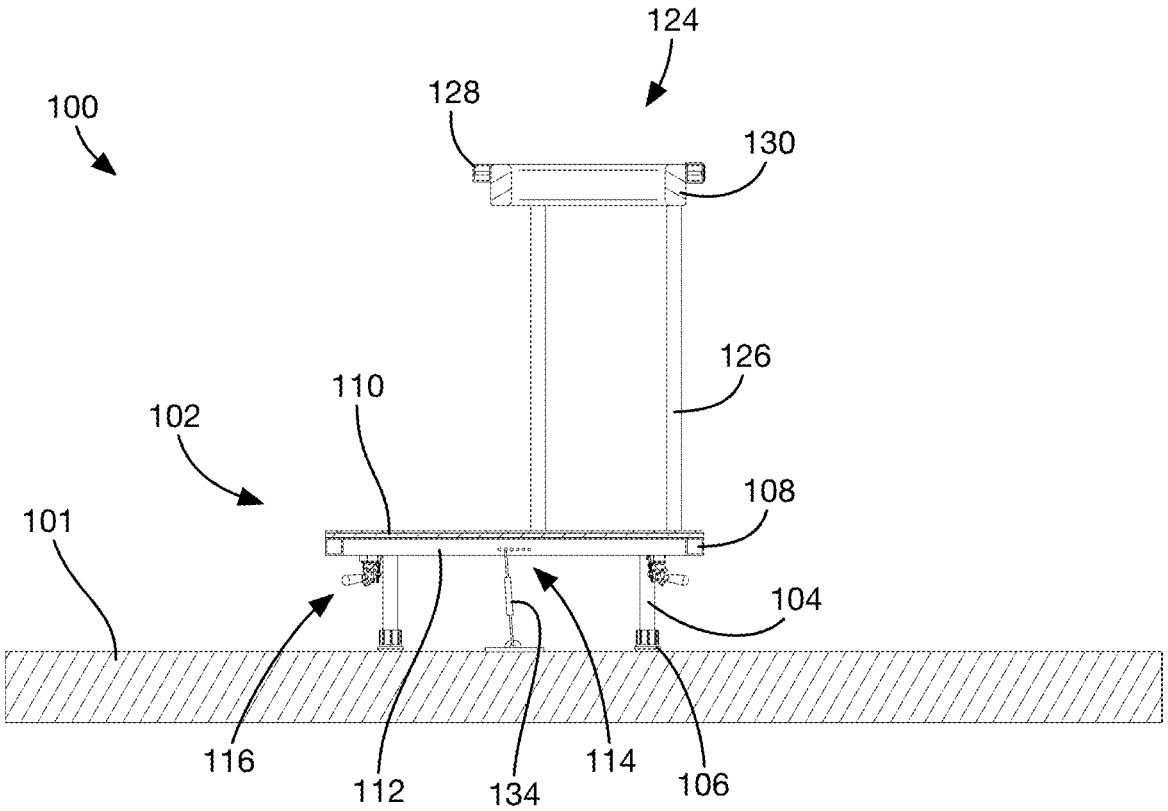
FIG. 10 is a cross-sectional view thereof.

The base plate 110 of the casting platform 102 provides a flat elevated surface on which a fisherman can stand while fishing. The illustrated base plate 110 is formed from a metal plate and does not include any holes for fasteners or the like. The base plate 110 is secured to the support frame 108 of the casting platform 102 by a plurality of clamps 116 attached to the support frame 108. The examples of clamps 116 shown in FIGS. 1-10 include a latch member 118 that engages a catch member 120 that is attached to the bottom surface of the base plate 110 with a bracket 122, such as, for example, an angle bracket as is shown in FIG. 7. The clamps 116 can take on a wide variety of forms, such as, for example, retaining slots for receiving a tab or a pin, threaded fasteners, quarter-turn fasteners, hook or slide locking mechanisms, or any combination thereof.

When closed, the clamps 116 provide sufficient clamping force to secure the base plate 110 of the casting platform 102 to the support frame 108. The clamping force applied by the clamps 116 can be adjusted by adjusting the relative positions of the latch member 118 and the catch member 120. In one implementation, the latch member 118 position can be adjusted via one or more adjustment members 132 that can be, for example, one or more threaded fasteners and an optional locking fastener. The clamping force of two or more clamps 116 can be sufficient to safely retain the base plate 110 of the casting platform 102, thereby providing a stable platform even if one or more of the clamps 116 fail or are inadvertently left open.

The base plate 110 of the casting platform 102 can include a wide variety of features for improving the stability, longevity, and comfort of the fisherman who is fishing from the casting platform 102. For example, the base plate 110 can include a rubberized or otherwise high-friction top surface for added grip. The base plate 110 can also include a support accessory 124 supported by one or more support posts 126 that extend vertically from the base plate 110. The support accessory 124 take on a wide variety of forms, such as, for example, a seat (not shown), a leaning rail (not shown), a wrap-around support cage 128 shown in FIGS. 1-9, or the like. The support cage 128 can also include optional cushions 130 to provide added comfort to the fisherman.

The clamps 116 can be quickly opened to allow for easy and fast removal of the casting platform 102 and the attached support accessory 124. That is, a first casting platform 102 with an attached seat can be removed and replaced with a second casting platform 102 that has an attached support cage, and vice versa. The interchangeability or modularity of the casting platform system 100 allows the owner to purchase one support frame 108 and any number of casting platforms 102 including a wide variety of support accessories 124, or to purchase additional casting platforms 102 with different support accessories 124 after the initial purchase of the casting platform system 100. The support accessories 124 can also be provided at a variety of fixed heights, necessitating the purchase of multiple support accessories 124 for fishermen of different heights.

Swapping out one casting platform 102 for another enables the boat owner (typically a fishing guide) to adapt to accommodate fishermen of different heights by attaching different height support accessories 124 depending on who is fishing. Rough weather forecasts can also be adapted to, for example, by attaching casting platform with the support cage 128 when rougher seas are predicted. The support cage 128 provides significant improvements to stability and comfort in rough seas or when standing and fishing for extended periods of time.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A casting platform system for mounting on a boat deck, the casting platform system comprising:

a support frame comprising a plurality of support legs and a plurality of clamps;

a casting platform that is removably attached to the support frame, the casting platform comprising:

a base plate comprising a plurality of catch members, wherein each of the plurality of clamps of the support frame has a latch member for engaging a corresponding catch member of the base plate; and a support accessory extending from and supported above the base plate.

2. The casting platform system of claim 1, wherein the base plate removably attaches to the support frame.

3. The casting platform system of claim 1, wherein the support frame comprises:

a perimeter frame formed from a plurality of tube segments; and a center beam extending between opposite sides of the perimeter frame.

4. The casting platform system of claim 3, wherein the center beam comprises an attachment location.

5. The casting platform system of claim 1, wherein the latch members of the plurality of clamps are adjustable.

6. The casting platform system of claim 1, wherein the base plate is removably attached to the support frame via a plurality of threaded fasteners.

7. A fishing boat comprising:

a deck;

a support frame supported above the deck by a plurality of support legs, the support frame comprising a plurality of clamps; and a casting platform comprising:

a base plate removably attached to the support frame by the plurality of clamps, wherein the base plate comprises a plurality of catch members, and wherein each of the plurality of clamps of the support frame comprises latch member for engaging a corresponding catch member of the base plate; and a support accessory extending upward from the base plate.

8. The fishing boat of claim 7, wherein the support frame comprises:

a perimeter frame formed from a plurality of tube segments; and a center beam extending between opposite sides of the perimeter frame.

9. The fishing boat of claim 8, wherein the center beam comprises an attachment location and the fishing boat further comprises a securing member extending from the deck to the attachment location of the center beam.

10. The fishing boat of claim 7, wherein the latch members of the plurality of clamps are adjustable.

11. The fishing boat of claim 7, wherein each of the plurality of clamps comprises a threaded fastener.

12. A method of using a casting platform system, the casting platform system comprising a support frame having a plurality of support legs, a first casting platform comprising a first base plate and a first support accessory extending from the first base plate, and a second casting platform comprising a second base plate and a second support accessory extending from the second base plate, the method comprising:

attaching the first casting platform to the support frame;

removing the first casting platform from the support frame; and attaching the second casting platform to the support frame.

13. The method of claim 12, wherein:

the support frame comprises a plurality of clamps;

the step of attaching the first casting platform comprises engaging the plurality of clamps to removably attach the first base plate to the support frame;

the step of removing the first casting platform comprises disengaging the plurality of clamps to disconnect the first base plate from the support frame; and the step of attaching the second casting platform comprises engaging the plurality of clamps to removably attach the second base plate to the support frame.

14. The method of claim 13, wherein:

the first base plate and the second base plate each comprise a plurality of catch members; and each clamp of the plurality of clamps has a latch member for engaging a corresponding catch member of one of the first base plate and the second base plate.

15. The method of claim 14, wherein the latch members of the plurality of clamps are adjustable.

16. The method of claim 13, wherein each of the plurality of clamps comprises a threaded fastener.

17. The method of claim 12, wherein one of the first support accessory and the second support accessory is a seat and the other of the first support accessory and the second support accessory is a support cage.

18. The method of claim 12, wherein the first support accessory has a first height, and the second support accessory has a second height that is different from the first height.

* * * * *